US006488350B2

(12) United States Patent
Iwasaki et al.

(10) Patent No.: US 6,488,350 B2
(45) **Date of Patent: *Dec. 3, 2002**

(54) INK JET PRINTING APPARATUS AND INK JET PRINTING METHOD

(75) Inventors: Osamu Iwasaki, Tokyo (JP); Naoji Otsuka, Yokohama (JP); Kaneji Yamada, Yokohama (JP); Minoru Teshigawara, Urawa (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/422,353

(22) Filed: Oct. 21, 1999

(65) Prior Publication Data

US 2002/0135625 A1 Sep. 26, 2002

(30) Foreign Application Priority Data

Oct. 27, 1998 (JP) ..... 10-306192

(51) Int. Cl.[7] ..... B41J 29/38
(52) U.S. Cl. ..... 347/12; 347/11
(58) Field of Search ..... 347/48, 29, 35, 347/12, 11, 15, 26

(56) References Cited

U.S. PATENT DOCUMENTS

| | | | | | |
|---|---|---|---|---|---|
| 4,313,124 | A | | 1/1982 | Hara | |
| 4,345,262 | A | | 8/1982 | Shirata et al. | |
| 4,459,600 | A | | 7/1984 | Sato et al. | |
| 4,462,359 | A | | 7/1984 | Ayata et al. | |
| 4,463,359 | A | * | 7/1984 | Ayata et al. | 347/56 |
| 4,558,333 | A | | 12/1985 | Sugitani et al. | |
| 4,608,577 | A | | 8/1986 | Hori | |
| 4,646,110 | A | * | 2/1987 | Ikeda et al. | 347/15 |
| 4,723,129 | A | | 2/1988 | Endo et al. | |
| 4,740,796 | A | | 4/1988 | Endo et al. | |
| 5,479,196 | A | * | 12/1995 | Inada | 347/92 |
| 5,646,659 | A | * | 7/1997 | Moriyama et al. | 347/55 |
| 5,731,828 | A | * | 3/1998 | Ishinaga et al. | 347/62 |
| 5,880,762 | A | * | 3/1999 | Ishinaga et al. | 347/62 |
| 6,062,678 | A | * | 5/2000 | Ishinaga et al. | 347/62 |
| 6,142,599 | A | * | 11/2000 | Ishinaga et al. | 347/15 |
| 6,154,237 | A | * | 11/2000 | Kashino et al. | 347/48 |
| 6,179,411 | B1 | * | 1/2001 | Saikawa et al. | 347/48 |

FOREIGN PATENT DOCUMENTS

| | | |
|---|---|---|
| EP | 0 719 647 | 7/1996 |
| EP | 0 792 744 | 9/1997 |
| EP | 0 816 084 | 1/1998 |
| JP | 54-56847 | 5/1979 |
| JP | 55-132259 | 10/1980 |
| JP | 59-123670 | 7/1984 |
| JP | 59-138461 | 8/1984 |
| JP | 60-71260 | 4/1985 |
| JP | 10-71718 | 3/1998 |

* cited by examiner

*Primary Examiner*—Judy Nguyen
(74) *Attorney, Agent, or Firm*—Fitzpatrick, Cella, Harper & Scinto

(57) ABSTRACT

The present invention reduces a difference in speed between a main drop section and a tailing section of a ejected ink droplet by heating a front heater and a rear heater provided for one nozzle with a predetermined time lag and thus, the ink dot formed from the main drop section and the tailing section on a printing medium can be more approximate to a circle. Thereby, it is possible to prevent print quality from being degraded by the tailing section separated from the main drop section of the ink droplet ejected from an ink jet printing apparatus of serial type.

22 Claims, 19 Drawing Sheets

INK JET PRINTING APPARATUS AND INK JET PRINTING METHOD

This application is based on Patent Application No. 10-306192 filed on Oct. 27, 1998 in Japan, the content of which is incorporated hereinto by reference.

BACKGROUND OF THE INVENTION

1. Field of the Invention

The present invention relates to an ink jet printing apparatus and an ink jet printing method and particularly, to an ink jet printing apparatus and an ink jet printing method using a print head in which a plurality of electro-thermal transforming elements are provided for each ink ejection opening and are adapted to be independently driven.

2. Description of the Prior Art

There have been provided an ink jet print head in which a plurality of electro-thermal transforming elements are provided in an ink passage communicating with an ink ejection opening and are individually driven, and a printing apparatus which uses such a print head, by the assignee of the present application. Such a print head has, for example, two independently driveable electro-thermal transforming elements in each of ink passages and generates bubbles in ink by utilizing thermal energy caused by driving the electro-thermal transforming elements so as to eject the ink by the pressure of the bubbles. Upon printing a low-density part of an image, one of the two electro-thermal transforming elements is driven to eject an ink droplet for forming the low-density part of an image. For a high-density part of the image, the two electro-thermal transforming elements are driven to eject an ink droplet for forming the high-density part of the image. Thus, printing having more gradation levels is performed so that images of photograph quality can be formed. Further, since the printing apparatus can form the image with the ink droplet ejected by driving these two electro-thermal transforming elements when forming the image such as a character, such an image can be formed with relatively large ink dots. As a result, printing can be performed at a resolution similar to that of printing that is originally performed at a low resolution; thereby, high speed printing can be accomplished.

In connection with a configuration having the plurality of electro-thermal transforming elements in each ink passage as described above, it has been disclosed in Japanese Patent Application Laid-open No. 55-132259 (1980) that gradation printing can be performed by varying generation timings of respective bubbles by the driving of the respective two electro-thermal transforming elements in the ink passage and changing amount of the respective ejected ink droplets.

Driving means which drives two electrothermal elements with a time lag (delay) of a slight amount for stable ejection of ink has been also disclosed in Japanese Patent Application Laid-open No. 10-071718 (1998) by the inventors of the present application.

However, in the ink jet printing apparatus of serial scan type in which printing (printing scan) is performed by reciprocating the print head relative to a printing medium and in which the plurality of electro-thermal transforming elements are driven for ejection of ink as described above, the following problems may occur, for example, when the apparatus has a plurality of ink ejection modes which have different ejection amounts of ink from each other.

In order to obtain an appropriate landing accuracy of the ejected ink in the ink ejection mode of small ejection amount, it is desirable that an ejection speed is faster than a predetermined value, for example, approximately 8 m/sec. As a configuration to achieve this ejection speed, it may be considered that a cross section of the ejection opening is made smaller. On the other hand, for the print head having such an ejection opening of smaller cross section, when all of the plurality of electro-thermal transforming elements provided for one ejection opening are simultaneously driven, a relatively large ejection speed, for example, approximately 18 m/sec, can be achieved. Furthermore, in this case, a flying ink droplet can take a shape as shown in FIG. 1 for the case of "simultaneous heat". More specifically, when the plurality of electro-thermal transforming elements are simultaneously driven, both a main droplet section of the ejected ink and a tailing section ejected in a trailed manner by the main droplet fly at noticeably large speeds and a difference between these speeds becomes noticeably large. The serial scan type printing apparatus, which scans the print head ejecting such ink droplet to the printing medium to perform printing, forms ink dots on the printing medium as shown in, for example, FIG. 2A. In FIGS. 2A through 2D, an arrow denotes a scanning direction of the print head, and a large dot is formed with the main drop section of the ejected ink and a small dot is formed with the tailing section of the ejected ink.

A reason why the dot from the main drop section and that from the tailing section are formed in a deviation manner from each other will be described below with reference to FIG. 3. FIG. 3 is a diagram showing the respective ejection of the main drop section and the tailing section from the print head and their landing positions on the printing medium. In this figure, the print head moves in the direction shown by an arrow Vcr at a speed Vcr. A distance between the printing medium and the ejection opening of the print head is denoted as d. Also, the ejection speed of the main drop section is denoted as Vm, the ejection angle with respect to the vertical direction of the printing medium is denoted as θ, and a distance in a head moving direction from the ejection start position of the main drop section to the landing position on the printing medium is denoted as Dm. In this case, the ejection angle of the tailing section is also denoted as θ, but the distance in the head moving direction from the ejection start position to the landing position is denoted as Dt and the ejection speed is denoted as Vt for the tailing section. Further, when time between the ejection of the main drop section from the ejection opening and the ejection of the tailing section from the ejection opening is denoted as ΔTd, the distance ΔDd over which the print head moves during the time ΔTd is expressed as follows:

$$\Delta Dd = Vcr \times \Delta Td \tag{1}$$

From the foregoing, time Tm between the ejection start of the main drop section and its landing is expressed as follows:

$$Tm = d/(Vm \times \cos\theta) \tag{2}$$

Also, the distance Dm is expressed as follows:

$$Dm = (Vcr + Vm \times \sin\theta) \times Tm \tag{3}$$

From the equations (2) and (3), the following equation is obtained:

$$Dm = d \times (Vcr/Vm + \sin\theta)/\cos\theta \tag{4}$$

Similarly, the distance Dt in the head moving direction from the ejection start position of the tailing section to the landing position is expressed as follows:

$$Dt=d\times(Vcr/Vt+\sin\theta)/\cos\theta \quad (5)$$

From the foregoing, the distance ΔD between the landing points of the main drop section and the tailing section is expressed as follows:

$$\Delta D=Dt+(\Delta Dd-Dm) \quad (6)$$

From the equations (1), (4), (5), and (6), the following equation is obtained:

$$\Delta D=Vcr\times\{(d/Vt-d/Vm)/\cos\theta+\Delta Td\} \quad (7)$$

From this equation, the following can be seen.

At the higher speed the print head moves, the larger the distance ΔD becomes. The term (d/Vt−d/Vm) in the equation indicates that, when the larger the difference between the respective flying times of the main drop section and the tailing section is, the larger the distance ΔD becomes. That is, when the larger the difference between the respective ejection speeds of the main drop section and the tailing section is, the larger the distance ΔD becomes. Further, when the larger the distance d between the printing medium and the ejection opening of the print head is, the larger the distance ΔD becomes.

When the ejection angle θ meets the condition: $|\theta|<15$ [deg], any possible effects of the ejection direction may be usually ignored because 1/cos θ is what has a value of (1<) 1/cos θ<1.04. An example of measurements taken by the present inventors for the plurality of electro-thermal transforming elements (hereinafter simply referred to as a "heater") driven simultaneously are as follows:

Vm=18 m/sec

Vt=8 m/sec

ΔTd=28 μsec

θ=15 deg

In this case, when the print head is moved at the speed of Vcr=0.508 m/sec and the distance between the printing medium and the ejection opening of the print head is d=1.9 mm, the following distance ΔD is obtained:

ΔD=81 μm.

When performing printing at a dot density of 360 dpi, the print head is designed so that the dot diameter becomes approximately 100 μm. The print head used for the measurement example described above also forms dots of approximately 100 μm across. That is, the dot radius is 50 μm, and therefore, when the distance ΔD between the landing points of the main drop section and the tailing section is 81 μm, the dot from the tailing section is formed outside another dot from the main drop section.

When a printing image is formed with dots having such a shape, the dots from the tailing sections are formed ahead of a line image of the main dots in the scanning direction of the print head (the arrow in the figure) as shown in FIG. 4 and the resulting image may have a front edge which appears blurred as compared with a rear edge of the printing image in the scanning direction. As a result, the print quality may degrade.

SUMMARY OF THE INVENTION

It is an object of the present invention to provide an ink jet printing apparatus and an ink jet printing method which can prevent any degradation in print quality from being caused by dots formed of tailing sections of an ejected ink.

In a first aspect of the present invention, there is provided an ink jet printing apparatus for using a print head which has a plurality of electro-thermal transforming elements provided for one nozzle and generates a bubble by utilizing thermal energy caused by driving the plurality of electro-thermal transforming elements to eject ink and for performing printing onto a printing medium by ejecting the ink from the print head, the apparatus comprising:

scanning means for scanning the print head relative to the printing medium; and driving means for driving the plurality of electro-thermal transforming elements of the print head to eject ink from the nozzle while the scanning means scans the print head, the plurality of electro-thermal elements being driven at different timings to eject the ink so as to form a dot more approximate circular shape than that formed with the ink ejected by driving the plurality of electro-thermal transforming elements simultaneously.

In a second aspect of the present invention, there is provided an ink jet printing method for using a print head which has a plurality of electro-thermal transforming elements provided for one nozzle and generates a bubble by utilizing thermal energy caused by driving the plurality of electro-thermal transforming elements to eject ink and for performing printing onto a printing medium by ejecting the ink from the print head, the method comprising the steps of:

scanning the print head relative to the printing medium; and driving the plurality of electro-thermal transforming elements of the print head to eject ink from the nozzle while the scanning step scans the print head, the plurality of electro-thermal elements being driven at different timings to eject the ink so as to form a dot more approximate circular shape than that formed with the ink ejected by driving the plurality of electro-thermal transforming elements simultaneously.

According to the configuration described above, a plurality of electro-thermal transforming elements provided for one ejection opening are driven at different timings from each other so that a dot formed with an ink ejected by driving them may be more approximate to a circular shape than a dot formed by driving them simultaneously. More specifically, when an ink droplet is separated into a main drop section and a tailing section through such an ink ejection caused by driving the plurality of electro-thermal transforming elements with a time lag, the dot formed from the tailing section can be made closer to another dot formed from the main drop section on the printing medium and the combined dots are more approximate a circular shape as a whole.

The above and other objects, effects, features and advantages of the present invention will become more apparent from the following description of embodiments thereof taken in conjunction with the accompanying drawings.

DESCRIPTION OF THE PREFERRED EMBODIMENT

An embodiment of the present invention is designed to determine drive timing for a plurality of electro-thermal transforming elements provided for each ejection opening of a print head based on the following experimentation.

According to the experimentation by the inventors of the present invention, when driving with a time lag a plurality of electro-thermal transforming elements provided for each ejection opening in a configuration of the print head and the printing apparatus used in the measurement example described above, various flying patterns as shown in FIG. 1 are obtained. As seen from these flying patterns, a speed of a main drop section of an ejected ink can be varied by relatively changing drive timing of a front heater located closer to the ejection opening in an ink passage and a rear heater located on a farther location from the ejection opening than the front heater. Further, the speed of a rear end of the tailing section is not so varied even if these heaters are driven at relatively changed timing.

Figure 2A:
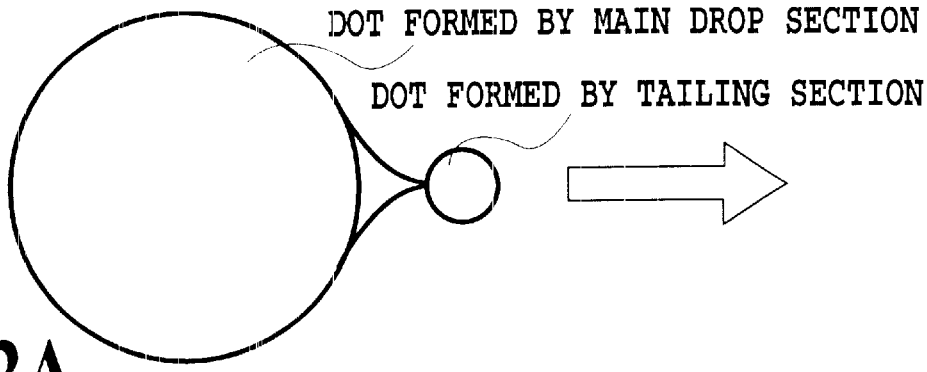
FIGS. 2A through 2D are diagrams schematically showing ink dot patterns, each of which is formed of the main drop section and the tailing section according to the above stated time lag.
Figure 2B:
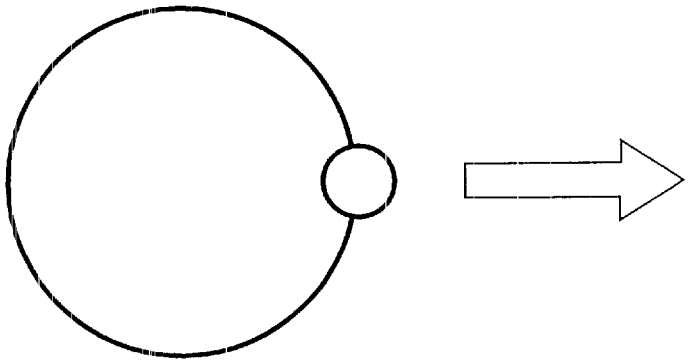
Figure 2C:
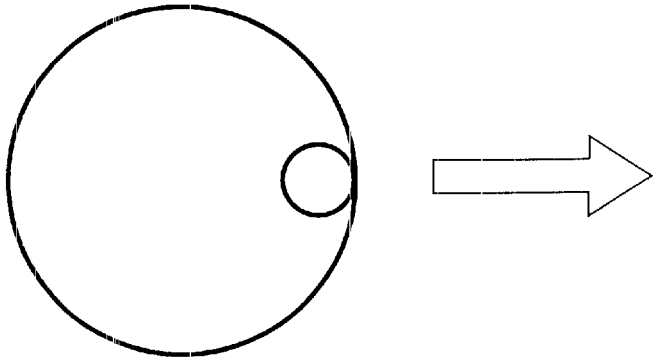

As in the printing of the measurement example described above, in the case that the print head is moved at the speed of Vcr=0.508 m/sec and the distance between the printing medium and the ejection opening of the print head is d=1.9 mm, the dot pattern shown in FIG. 2B is obtained for a condition that the front heater is driven approximately 1 $\mu$sec earlier than the rear heater. Also, the dot pattern shown in FIG. 2C is obtained for the condition that the front heater is driven approximately 2 $\mu$sec earlier.

Figure 1:
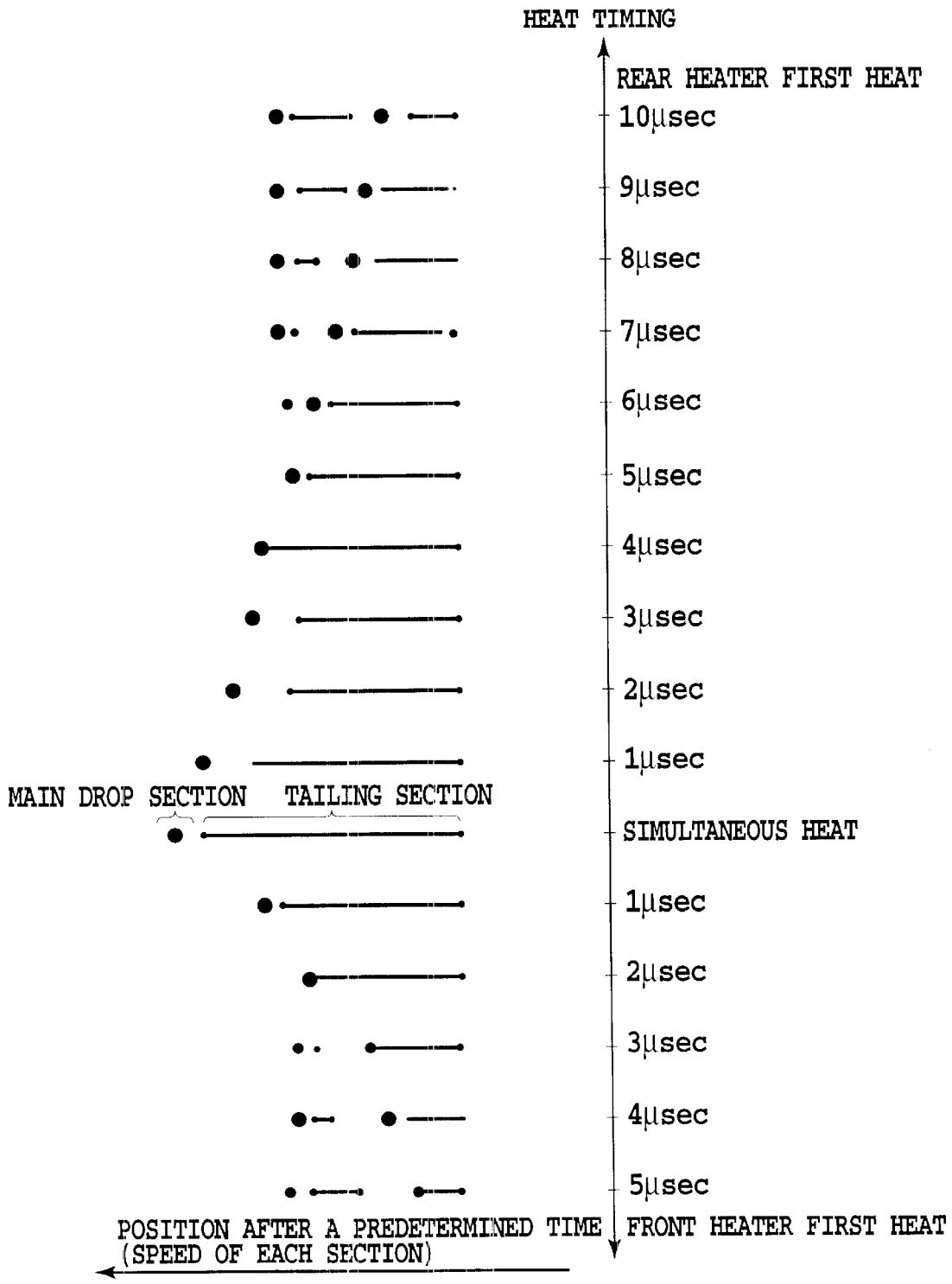
FIG. 1 is a diagram showing various flying patterns, each of which comprises a main drop section and a tailing section of an ejected ink formed by driving two heaters provided for one nozzle with a time lag.
Figure 2D:
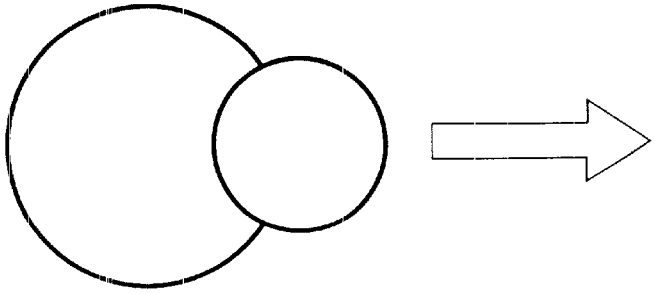
Figure 3:
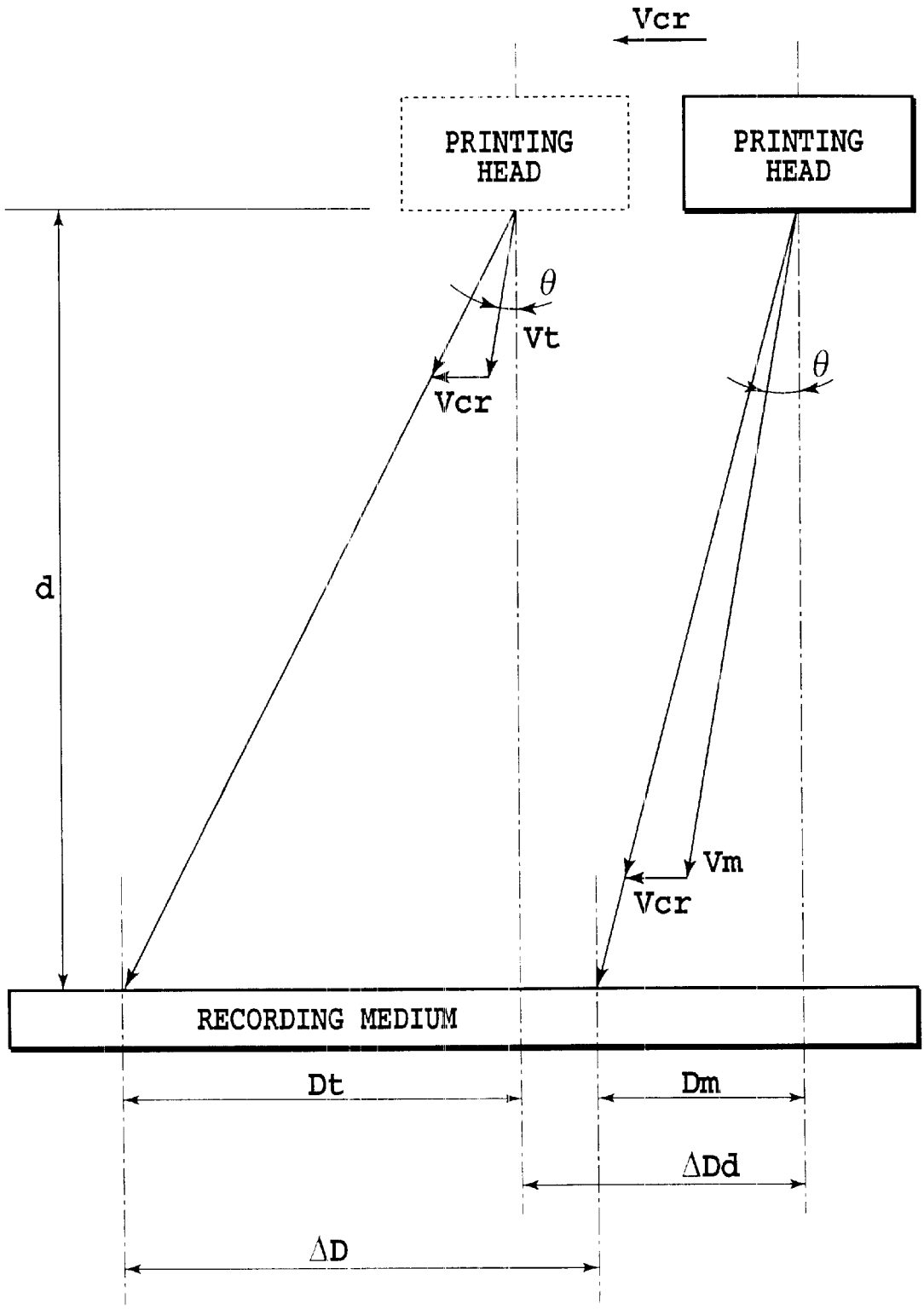
FIG. 3 is a diagram explaining a principle for a time lag in landing points of the main drop section and the tailing section.
Figure 4:
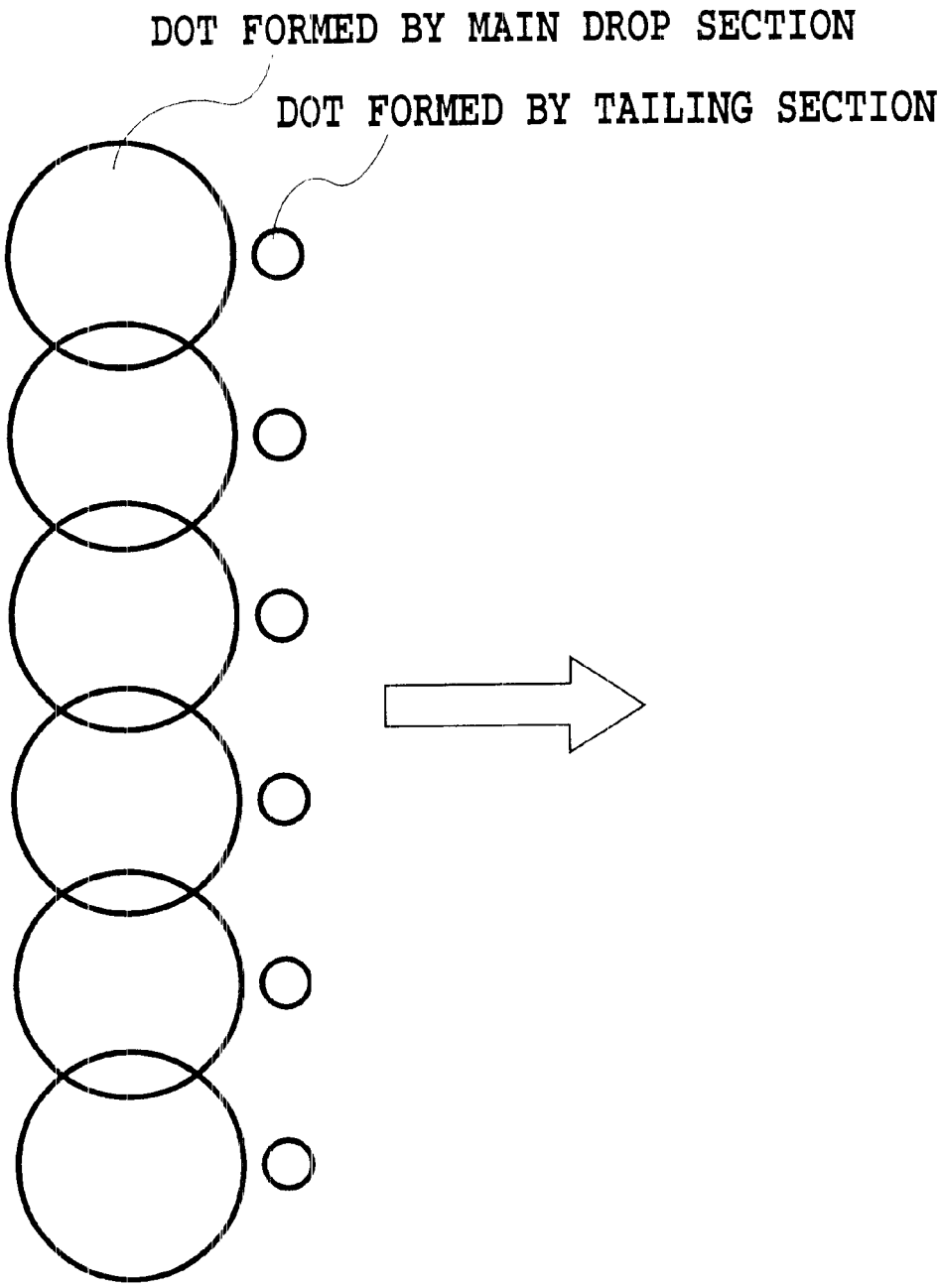
FIG. 4 is a diagram explaining how print quality may degrade due to the tailing sections of the ejected ink droplet.

Further, for the condition that the front heater is driven approximately 4 $\mu$sec later than the rear heater, the dot pattern of FIG. 2B is obtained. Moreover, for the condition that the front heater is driven approximately 3 $\mu$sec or earlier, the flying droplet is separated to form two droplets as shown in FIG. 1 and the formed dot with these separated droplets is a smaller one as shown in FIG. 2D. It may be seen that each droplet of these separated dots is smaller than that in the previous pattern because the flying droplet is separated to form these two droplets. Therefore, any dot formed as shown in FIG. 2D has a shorter length in the direction perpendicular to the printing scanning direction and such a dot formation will be unsuitable to form both the length and the width of a dot matrix at the same resolution.

In an ink jet printing apparatus of the serial scan type according to the embodiment of the present invention, two or more electro-thermal transforming elements provided for each ejection opening (nozzle) are driven at a shifted timing relative to each other so that a dot formed with a main drop section and a tailing section of an ejected ink drop can more approximate a circular shape than that formed by driving these elements simultaneously.

Now, more definite embodiment of the present invention will be described below in detail with reference to the drawings.

Description of the Printing Apparatus Body

Figure 5:
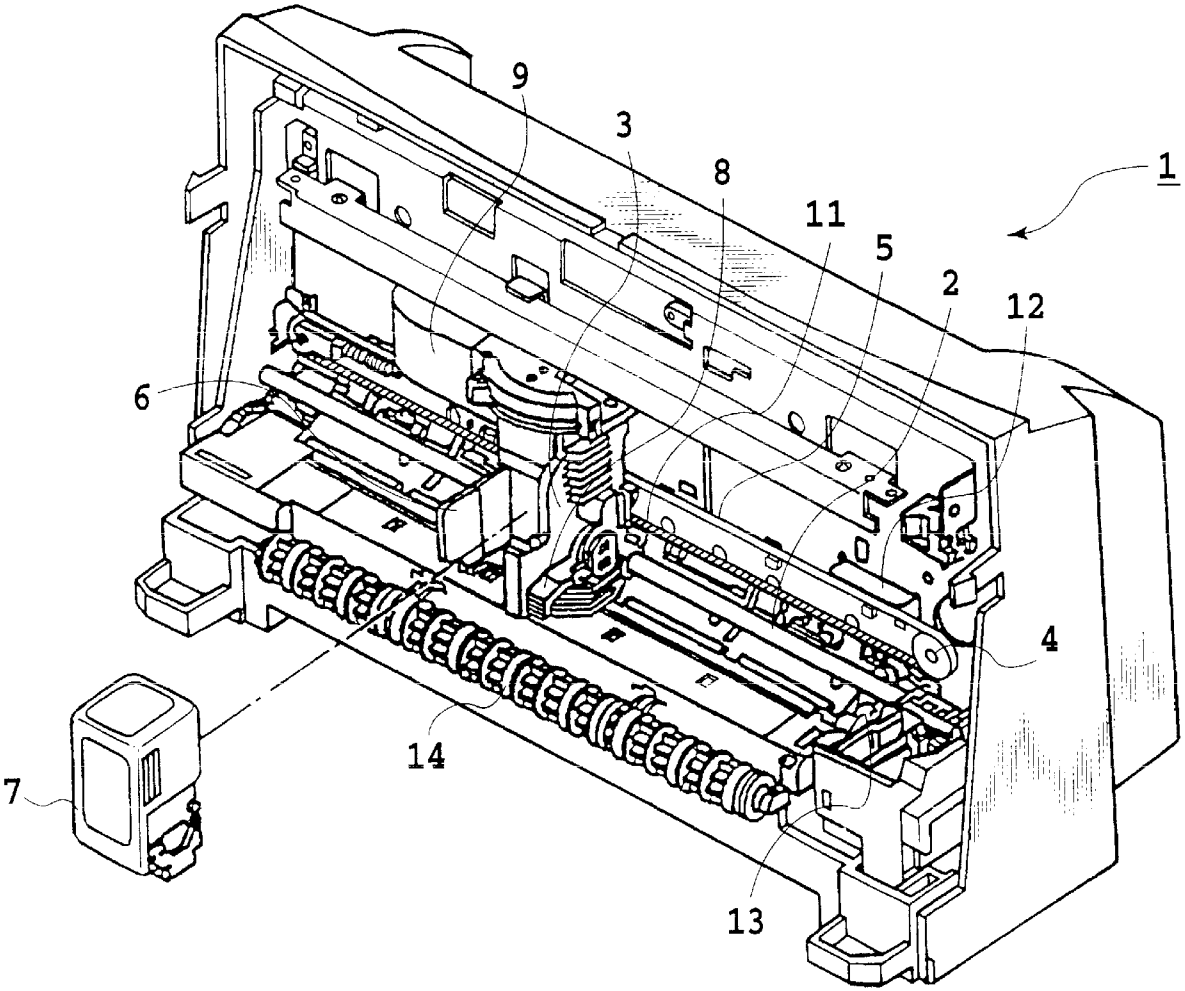
FIG. 5 is a perspective view showing an inner structure of an ink jet printer according to an embodiment of the present invention.

An ink jet printing apparatus according to the present embodiment is implemented as a color printer of serial type. FIG. 5 is a perspective view showing the inner mechanism of this color printer.

A guide shaft 2 is arranged within a range of movement of a carriage unit 3 and the carriage unit 3 is movably supported by the guide shaft 2 to enable the movement of the carriage unit 3. In parallel to the guide shaft 2, an endless timing belt 5 is circularly extended by a pair of timing pulleys 4 and the carriage unit 3 is coupled to this timing belt 5. This allows the driving force of a motor (not shown) to be transmitted to the carriage unit 3 through the timing belt 5 and then the carriage unit may be driven for movement.

This carriage unit 3 is provided with a cartridge holder 6 and an ink jet cartridge 7 which integrally includes an ink tank and a print head is mounted on the cartridge holder 6 in a replaceable manner. More specifically, the cartridge holder 6 is provided to be dislocated in an interlocking manner with a pivot manual lever 8 and the ink jet cartridge 7 can be removably held depending on the pivot motion of the manual lever 8. Also, the carriage unit 3 is provided with a plurality of terminals (not shown) which come into electrical contact with the ink jet cartridge 7 and these terminals are electrically connected with a control circuit described below through a flexible cable 9. In addition, a position sensor 11 configured by a photo-coupler is mounted on the carriage unit 3 and the position sensor 11 detects a light block plate 12 provided on the apparatus body when the carriage unit 3 is in its home position, thereby allowing the home position to be detected. Based on a detection signal from the position sensor 11, a home position unit 13 including a head recovery system is controlled.

At a position to which the ink jet cartridge 7 mounted on the carriage unit 3 can face, a path for carrying print sheets (not shown) sequentially in the vertical scanning direction is formed with a guide plate (not shown) or a feed roller 14.

Description of the Print Head

Figure 6:
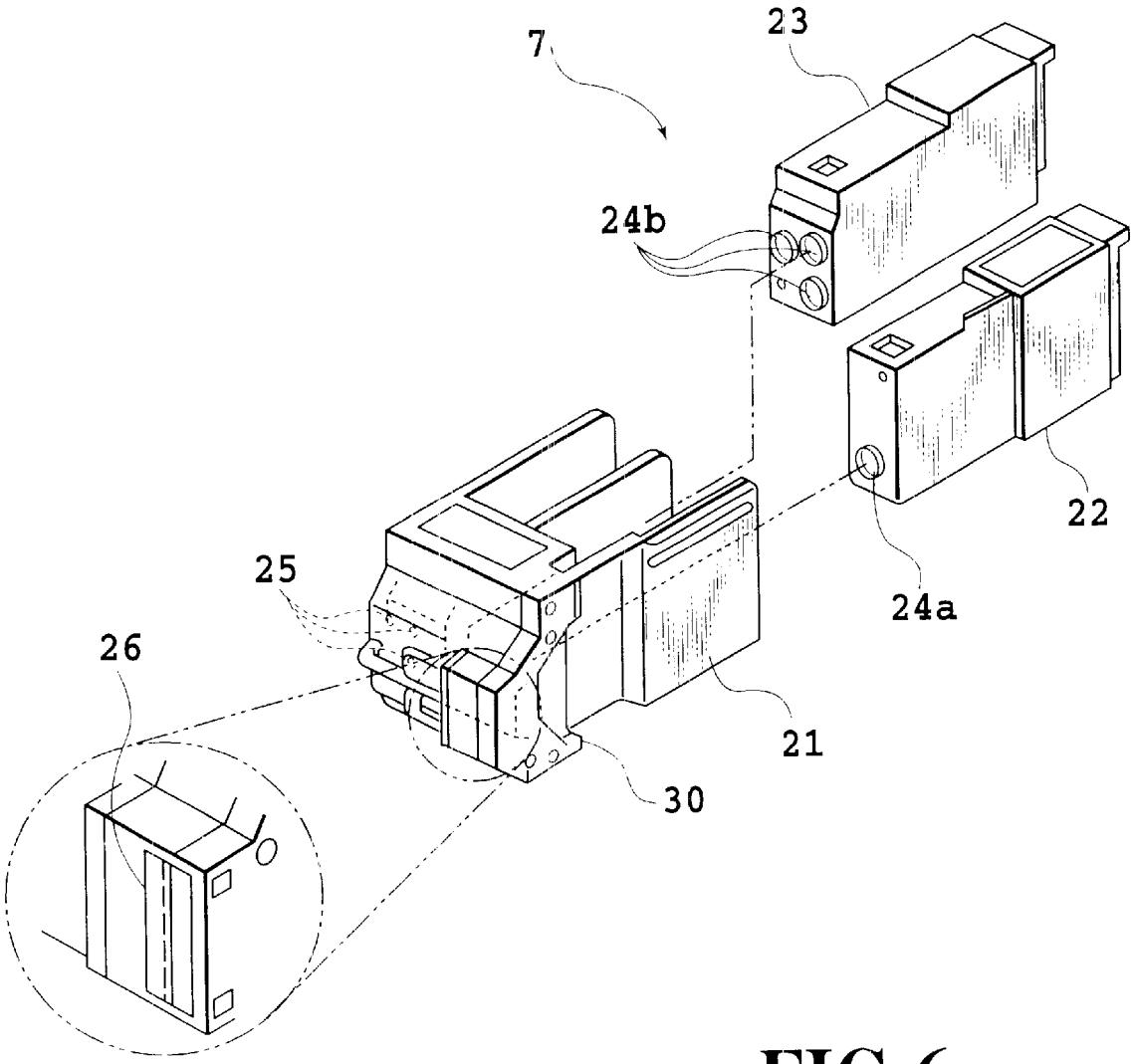
FIG. 6 is an exploded perspective view showing an ink jet cartridge used for the printer.

The ink jet cartridge 7 mainly comprises the print head and the ink tank. FIG. 6 is an exploded perspective view showing the ink jet cartridge 7.

The ink jet cartridge 7 comprises a cartridge body 21 and a tank 22 for black ink (K) and a color ink tank 23 having separate reservoirs for yellow ink (Y), magenta ink (M), and cyan ink (C), respectively are removably mounted on the cartridge body 21. These tanks 22 and 23 are provided with ink outlets 24*a* and 24*b*, respectively, while the cartridge body 21 has ink inlets 25 to be coupled with the ink outlets 24.

On the other hand, the print head according to the present embodiment is formed as a print head section 26 integrated with the cartridge body 21. The ink inlets 25 described above are in communication with the print head section 26, thereby allowing ink supply from these ink tanks to the print head. The print head section 26 has a predetermined number of nozzles for each of ink colors Y, M, C, and K. The print head section 26 is formed by bonding a heater board 28 to a top plate on which these nozzles are formed and the heater board 28 has a plurality of electrothermal elements provided at a location corresponding to each nozzle. The heater board is electrically connected with a terminal (not shown) of the carriage unit 3 through a terminal 30 formed on the side of the cartridge body 21.

Description of the Heater Board

Figure 7:
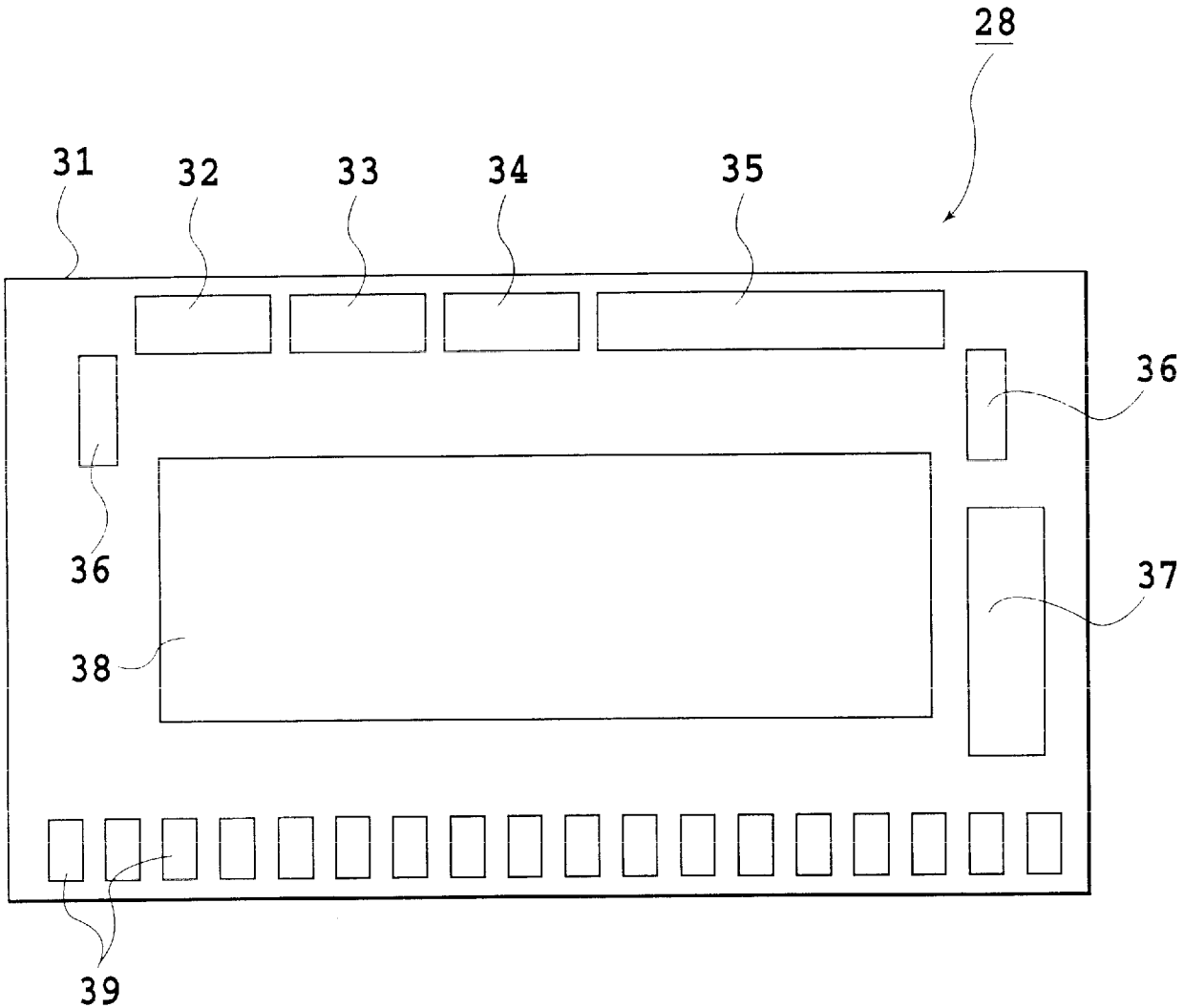
FIG. 7 is a schematic plan view showing a heater board which configures a print head for the ink jet cartridge.

FIG. 7 is a diagram schematically showing the above-mentioned heater board which configures the print head.

The heater board 28 includes a silicon substrate 31 as the base and groups of electro-thermal transforming elements (heater groups) 32 through 35 are provided for the respective colors on the front edge (a top edge in the figure) of the surface of the substrate 31. Each of these heater groups 32 through 35 comprises a plurality of electro-thermal transforming elements (heaters) and two heaters are provided for one nozzle as described below. That is, on the surface of the silicon substrate 31, a separation wall (not shown) to configure a nozzle is formed through a thin-film manufacturing process and a separate top plate (not shown) is bonded to the separation wall to form the nozzle and an ink passage in communication therewith.

The heater groups 32 through 34 are provided for the respective ink colors Y, M, and C and each of them is corresponding to 16 nozzles provided at a density of 360 dpi. On the other hand, the heater element group 35 is provided for K ink and corresponding to 64 nozzles provided also at a density of 360 dpi. These heater element groups 32 through 35 are separated from each other with a space for 8 nozzle pitches.

On each end of the heater board 28, a sub-heater 36 is provided to control the temperature of the respective print heads (and their ink) and on one end, a rank heater 37 is provided to measure the resistance of these electro-thermal transforming elements. In addition, a driving circuit 38 is formed on its central portion through the thin-film manufacturing process to drive the heater groups 32 through 35 and the sub-heater 36 described above and terminals 39 electrically connected with this driving circuit 38 are formed on the rear edge of the heater board 28.

Description of the Heater in the Print Head

Figure 8:
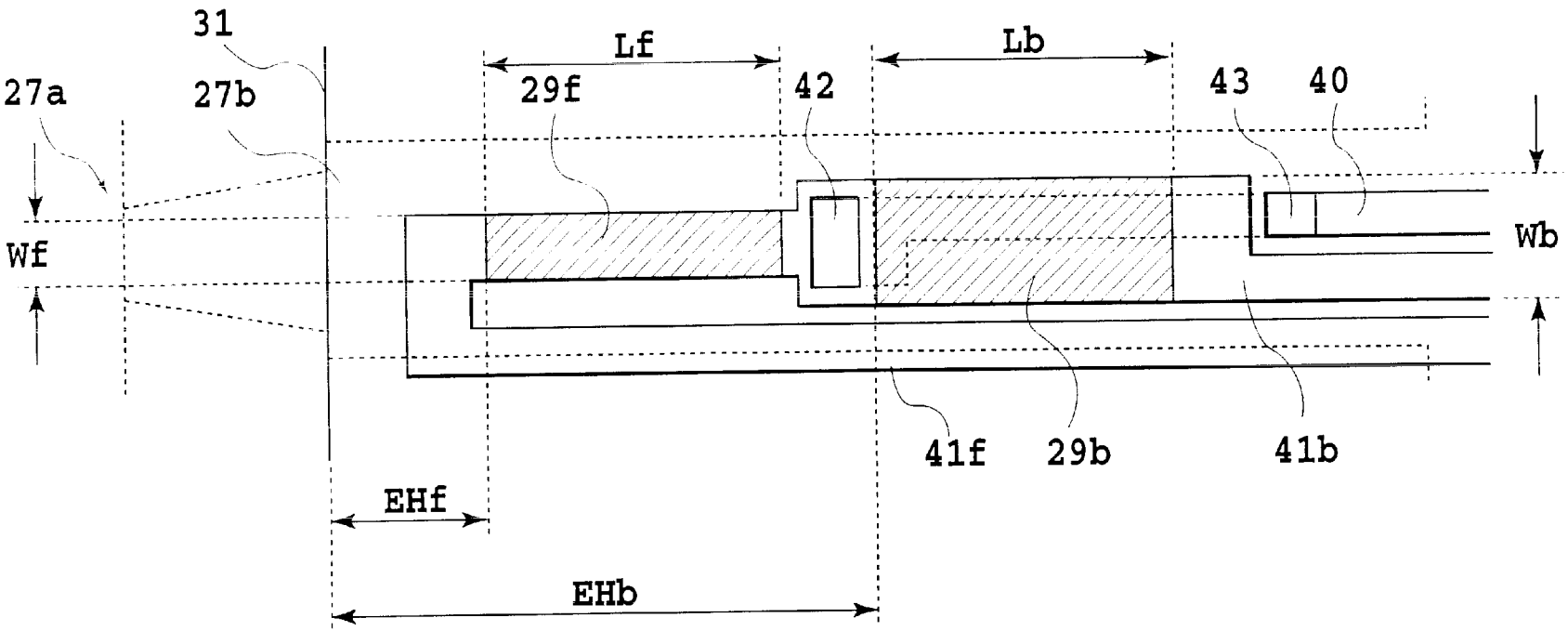
FIG. 8 is a schematic plan view showing a heater arrangement in an ink passage of the print head.

FIG. 8 is a schematic view showing an arrangement in the ink passage for each nozzle of the print head.

In an ink passages 27*b* in communication with a nozzle 27*a* of the print head, two electro-thermal transforming elements (hereinafter also referred to as simply "heaters") 29*f* and 29*b* are disposed. These heaters 29*f* and 29*b* are formed in an elongated rectangular shape and the area of the heater 29*b* located closer to the rear end in the ink ejection direction is larger than that of the front heater 29*f*. That is, the front heater 29*f* is formed as a rectangle having the length Lf=96 ($\mu$m) and the width Wf=23 ($\mu$m) from a thin film of high-resistance metal and its front edge is located at a distance EHf=50 ($\mu$m) from the front end of the nozzle 27*a*. On the other hand, the rear heater 29*b* is formed as a larger rectangle having the length Lb=94 ($\mu$m) and the width Wb=41 ($\mu$m) also from a thin film of high-resistance metal and its front edge is located at a distance EHb=176 ($\mu$m) from the front end of the nozzle 27*a*. A common electrode 40 made of a thin film of metal is three-dimensionally connected with the rear edge of the heater 29*f* and the front edge of the heater 29*b* through the respective through-holes 42 and 43 and individual electrodes 41*f* and 41*b* made of a thin file of low-resistance metal are separately connected with the front edge of the heater 29*f* and the rear edge of the heater 29*b*, respectively. The common electrode 40 is connected with ground wiring (not shown) and the individual electrodes 41*f* and 41*b* are connected with the driving circuit 38 (see FIG. 7).

Description of the Logic for the Heater Board

Figure 9:
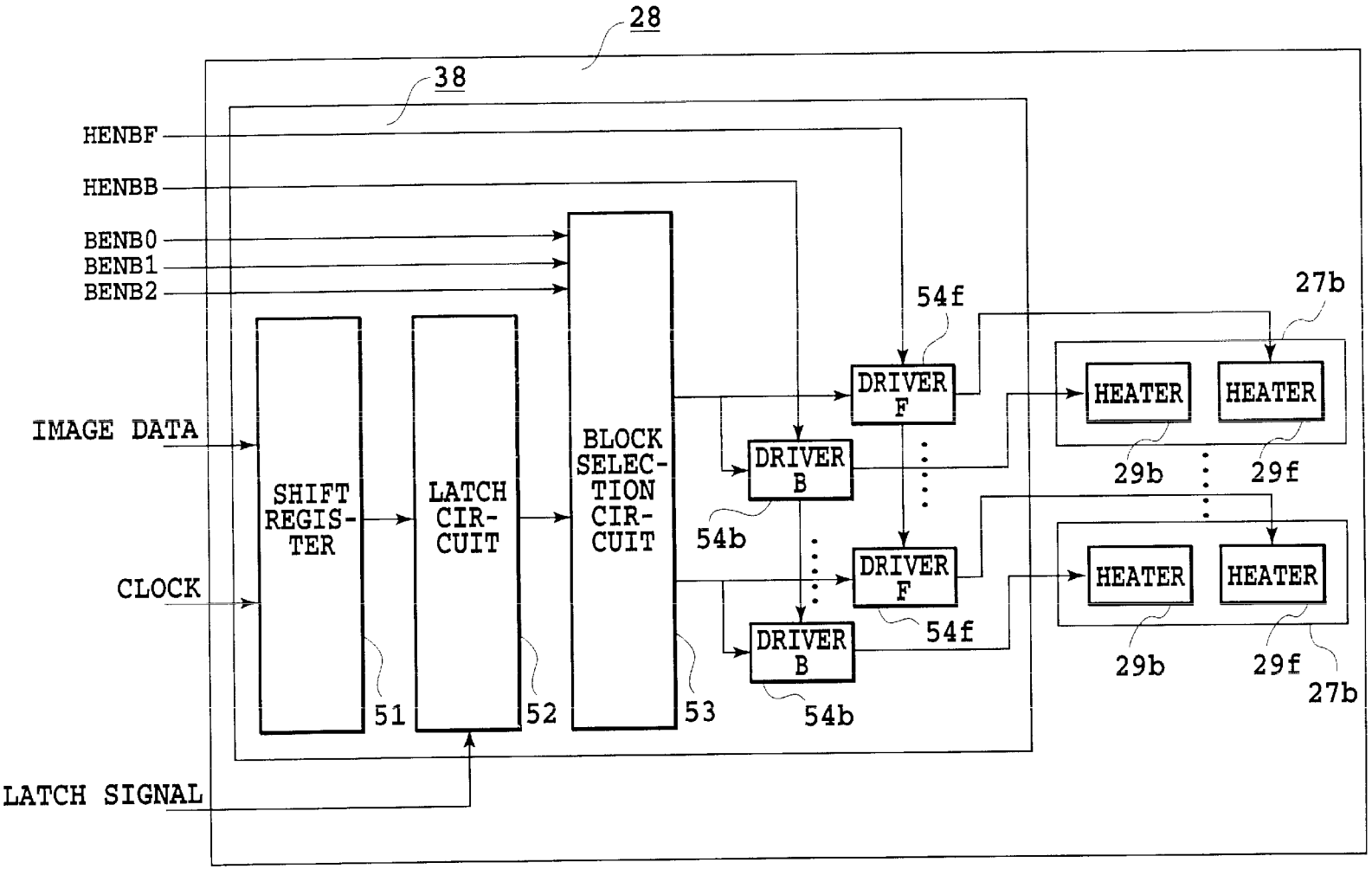
FIG. 9 is a block diagram conceptually showing functions of a driver circuit in the print head.

A driving circuit 38 provided in the heater board 28 is configured by including a shift register 51, a latch circuit 52, a block selection circuit 53, and driver circuits 54*f* and 54*b* as shown in FIG. 9. The circuit 38 is formed on the silicon substrate 31 (see FIG. 7) through a thin-film manufacturing process like the heaters 29*f* and 29*b*. It should be noted that FIG. 9 shows the function of the driving circuit 38 in a block diagram for conceptual explanation and that it does not show any actual circuit configuration. The driver circuits 54*f* and 54*b* are connected with the individual electrodes 41*f* and 41*b* of the heaters 29*f* and 29*b*, respectively and are also connected with the block selection circuit 53. This block selection circuit 53 is connected with the latch circuit 52, which is in turn connected with the shift register 51.

Figure 10:
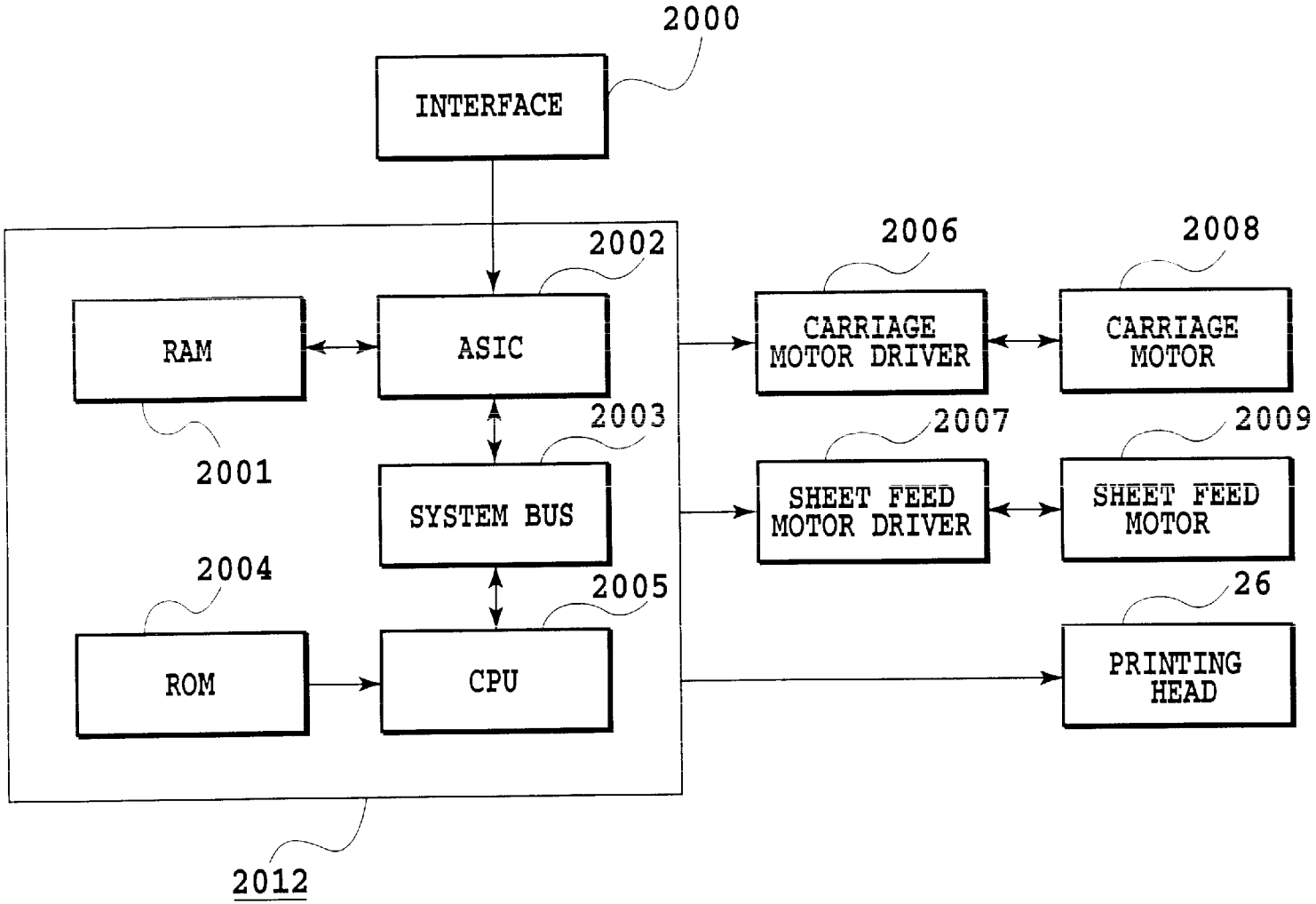
FIG. 10 is a block diagram showing a control configuration for the printer.

The shift register 51 receives image data and clock signals from a control circuit for the apparatus body as described below with reference to FIG. 10 and thus, it can hold image data serially provided in synchronization with the clock signals. The latch circuit 52 similarly receives latch signals from the control circuit as described below with reference to FIGS. 12 and 13 and thus, it can latch the image data held in the shift register 51.

The block selection circuit 53 receives three block selection binary signals BENB0 through BENB2 from the control circuit and then makes the image data latched in the latch circuit 52 correspond with one of eight blocks according to a combination of the block selection signals BENB0 through BENB2 to transfer the corresponding image data to the driver circuits 54*f* and 54*b*.

That is, the present embodiment performs 8-block (two nozzles per block) time-division driving for the colors Y, M, and C and 8-block (eight nozzles per block) time-division driving for the color K. It should be noted that FIG. 9 shows the configuration of two nozzles for each of the colors Y, M, C, and K.

The driver circuits 54*f* and 54*b* receive heat enable signals HENBF and HENBB from the control circuit and drive the heaters 29*f* and 29*b* based on the image data received from the block selection circuit 53, respectively. In this way, the enable signals HENBF and HENBB supplied to the driver circuits 54*f* and 54*b* are corresponding to the front heater 29*f* and the rear heater 29*b*, respectively and these signals determine the shape of each voltage pulse applied to them for driving each heater. It should be noted that in the following explanation, these signals may be described to be identical to the applied voltage pulses. It should be also noted that in the present embodiment, a double pulse comprising a pre-pulse for preheat and a main pulse for generating a bubble is used as an applied voltage pulse.

According to the present embodiment, as described above with reference to FIGS. 2A through 2D, the main pulse of the heat enable signal HENBF for the front heater 29*f* and that of the heat enable signal HENBB for the rear heater 29*b* are set to terminate with a time lag of 1 μsec. It should be further noted that among those shown in FIGS. 2A through 2D, though the dot pattern in FIG. 2C is more approximate to a circle than the others, the minimum time lag allowable for image quality would be 1 μsec as described above.

Description of the Driving Section for the Printing Apparatus Body

A control configuration for controlling a printing operation in the ink jet printing apparatus according to the present embodiment will be described below with reference to the block diagram in FIG. 10.

In the figure showing a control circuit, the reference numeral 2000 denotes an interface which receives printing signals from a host apparatus, 2005 denotes a CPU, 2004 denotes a program ROM which stores a control program executed by the CPU 2005, and 2001 denotes a RAM which keeps various types of data (the block selection signals and the heat enable signals as described above as well as printing data to be supplied to the print head). The reference numeral 2002 denotes an ASIC which controls the supply of printing data to the print head 26 and also controls data transfer between the interface 2000, the CPU 2005, and the RAM 2001. The reference numeral 2003 denotes a system bus over which data transfer is performed between the CPU 2005 and the ASIC 2002. The reference numeral 2008 denotes a carriage motor which enables the scanning of the print head 26 and 2009 denotes a sheet feed motor which carries printing medium. The reference numerals 2006 and 2007 denote motor drivers which drive the carriage motor 2008 and the sheet feed motor 2009, respectively. The reference numeral 2012 denotes the control circuit.

Now, the operation of the control configuration described above will be described below. When the interface 2000 receives a printing signal from the host apparatus, the printing signal is transformed to printing data (image data) to be printed through data exchange between the ASIC 2002 and the CPU 2005. Then, the motor drivers 2006 and 2007 are driven and the print head 26 is driven to perform the print operation according to the printing data and the head drive signal.

Figure 11:
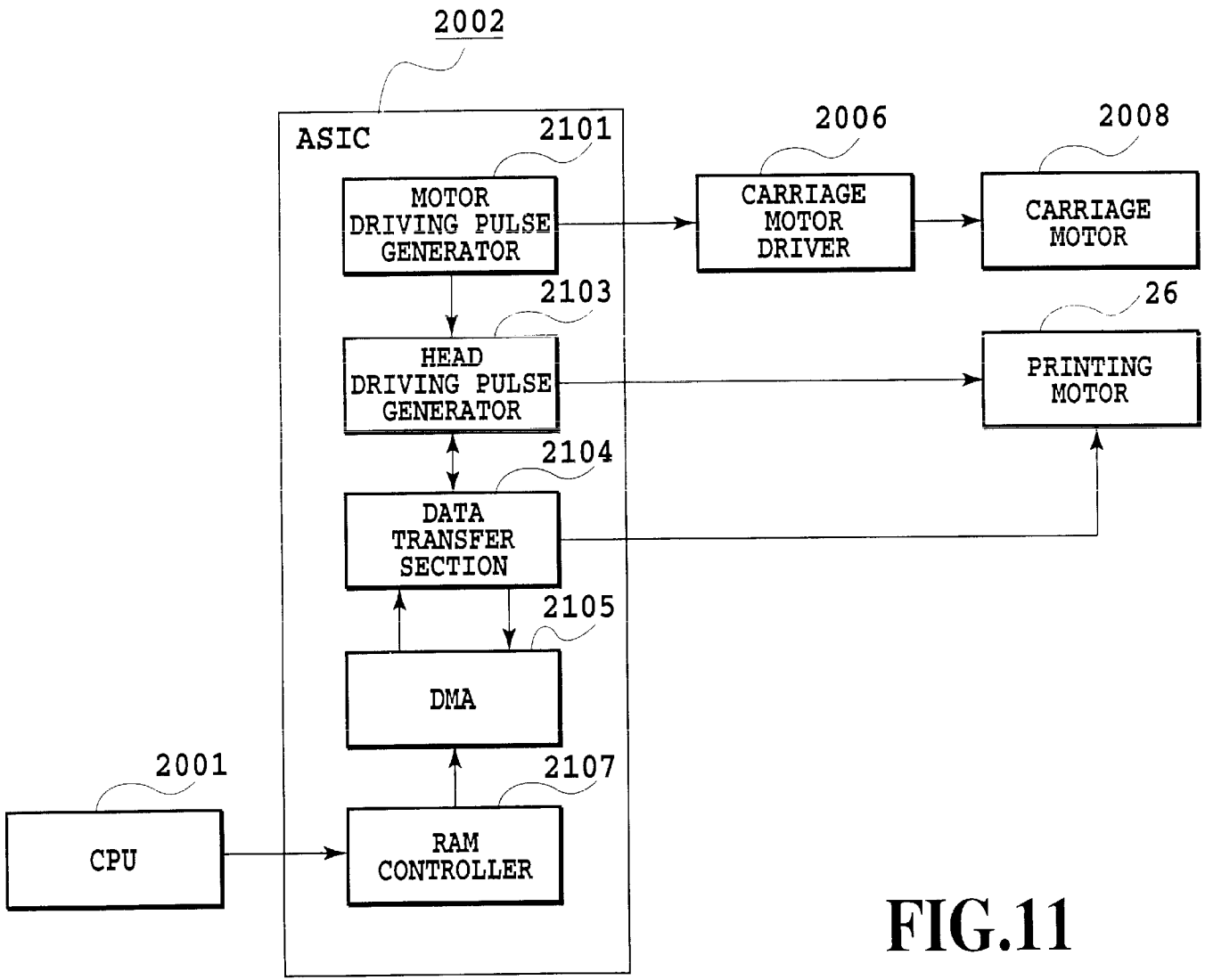
FIG. 11 is a block diagram mainly showing a specific configuration of an ASIC used in the control configuration.

Next, the specific configuration of the ASIC 2002 will be described below with reference to the block diagram shown in FIG. 11. The reference numeral 2101 denotes a generator which generates motor pulses for printing scan and the motor pulse generator 2101 generates driving signals to control the carriage motor 2008 and forwards them to the carriage motor driver 2006. In synchronization with the motor pulses, a head driving pulse generator 2103 forwards the enable signals described above to drive the print head 26. Then, the head driving pulse generator 2103 forwards to a data transfer section 2104 synchronization signals to transfer image data to be printed by the print head in synchronizm with the above-mentioned signals forwarded to the print head. The data transfer section 2104 transfers image data for a period to the print head 26 in synchronizm with the synchronization signals from the head driving pulse generator 2103. That is, such image data for a period has been stored in the RAM 2001 and after this stored data is transferred to the data transfer section 2104 through a RAM controller 2107 and a DMA controller 2105, the data transfer section 2104 transfers the image data to the print head. After this transfer, a transfer end signal is supplied to the DMA 2105.

The DMA controller 2105 begins to transfer the next image data upon receipt of the transfer end signal. It should be noted that the DMA controller 2105 is programmed to control image data to be transferred to the print head by specifying to the RAM controller 2107 the starting address and the ending address of image data for each scanning (or the amount of data) stored in the RAM 2001.

Description of the Head Driving Pulse Generator

Figure 12:
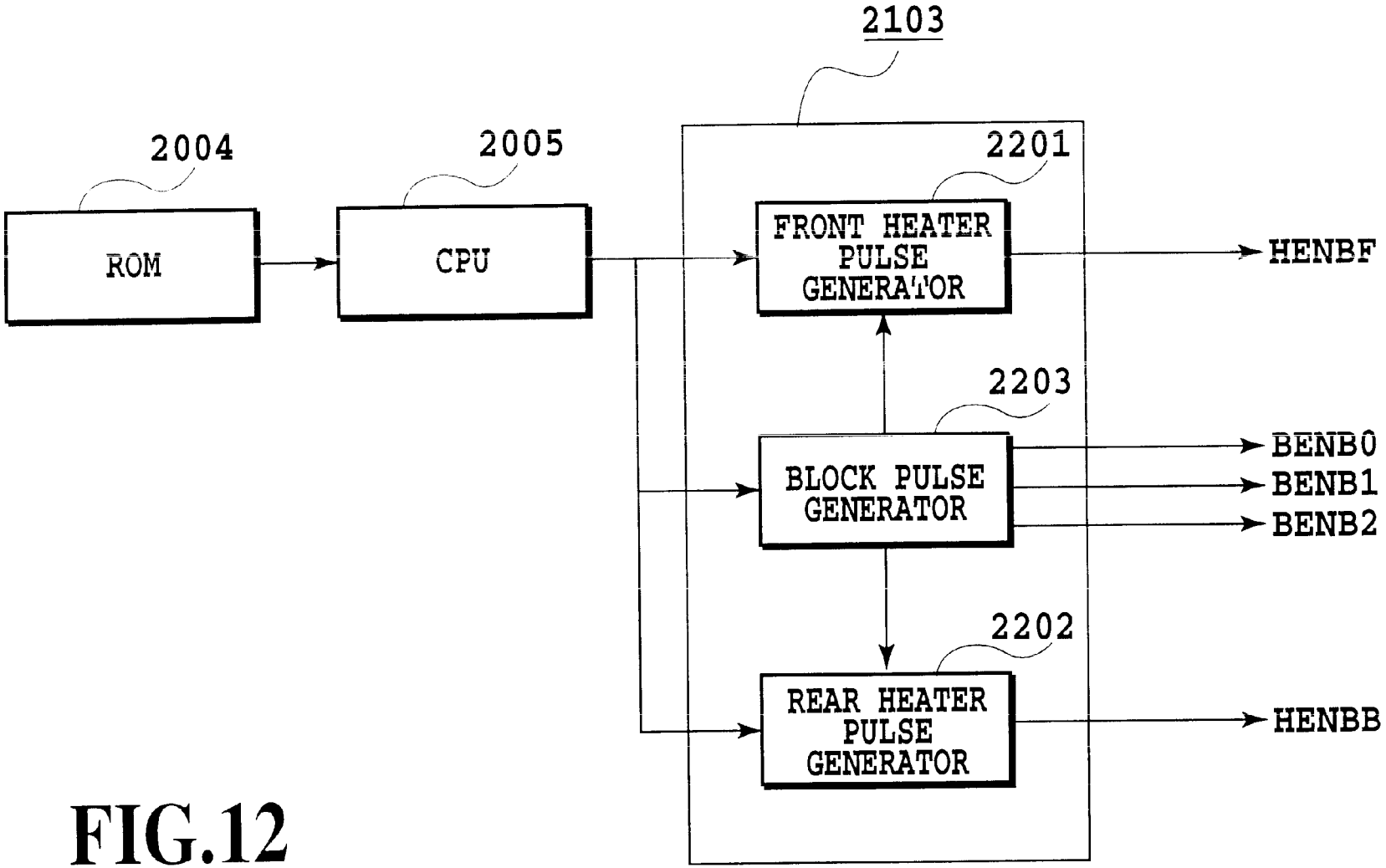
FIG. 12 is a block diagram mainly showing a specific configuration of a head driving pulse generator in the ASIC.

Next, the specific configuration of the head driving pulse generator 2103 in the ASIC 2002 will be described below with reference to FIG. 12.

Figure 13:
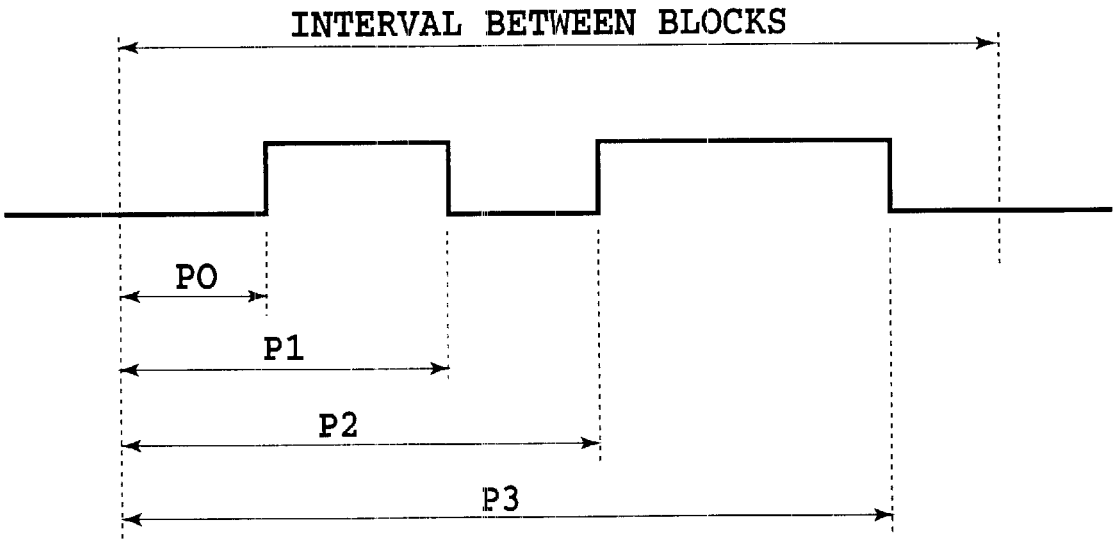
FIG. 13 is a diagram showing setting of a heat enable signal in the ASIC.

In the head driving pulse generator 2103, a front heater pulse generator 2201 and a rear heater pulse generator 2202 are set according to pulse settings stored in the ROM 2004 and read by the CPU 2005. As shown in FIG. 13, these pulse settings determine the period P0 from the start of block driving to the start of a preheat pulse, the period P1 from the start of block driving to the end of the preheat pulse, the period P2 from the start of block driving to the start of a main heat pulse, and the period P3 from the start of block driving to the end of a main heat pulse, and thereby the waveform of the pulse can be determined. It should be noted that when the periods P0, P1, P2, and P3 are set to be 0, the heat pulse would remain at Low level. Also, the block pulse generator 2203 can determine and provide the patterns for BENB0, BENB1, and BENB2 according to the pulse settings stored in the ROM 2004 in a similar manner to that for the heater pulses described above. The front heater pulse generator 2201 and the rear heater pulse generator 2202 provide the respective pulses determined in synchronous with the block pulse generator.

A circuit forming these pulse generators 2201, 2202 is provided with a programmable counter to which a pulse setting value can be set.

Description of the Image Formation

As described above, ink ejection from each nozzle in the ink jet print head will be delayed sequentially for every block by performing block driving. On the contrary, since the print head ejects ink to perform printing on the sheet while scanning with the carriage unit 3, the vertical arrangement of printed dots will be inclined and this may impair the printing quality.

Figure 14:
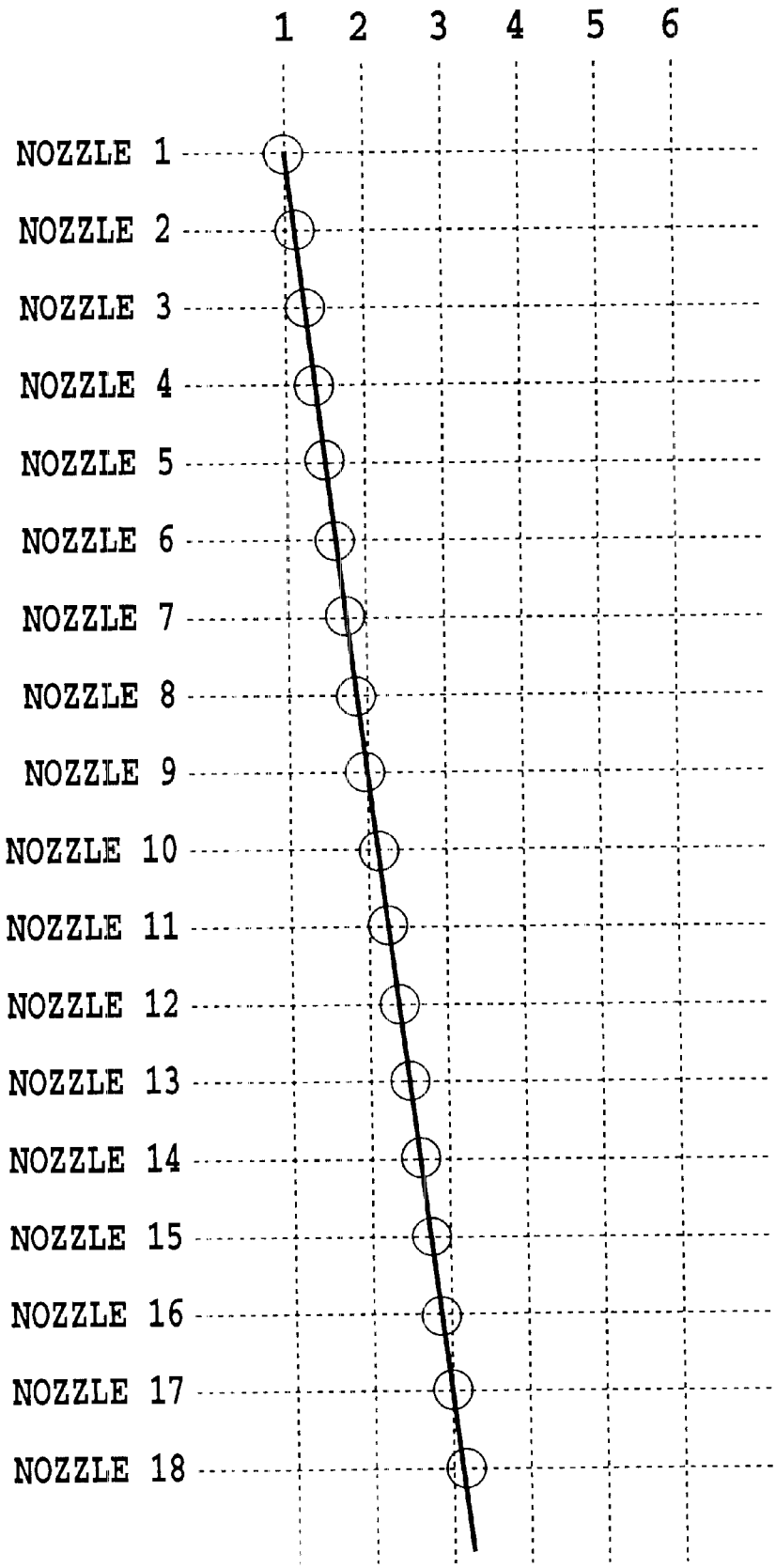
FIG. 14 is a diagram showing an inclined nozzle arrangement in the print head according to the embodiment.

Therefore, as shown in FIG. 14, the present embodiment forms a print head so that the nozzle arrangement may be inclined with respect to the sub-scanning direction when the ink jet cartridge 21 is mounted on the carriage unit 3. That is, since the inclination of the nozzle arrangement can be determined according to the scanning speed of the print head and the driving interval between blocks, dots formed by ejecting ink sequentially from a plurality of nozzles while scanning in the main-scanning direction can be arranged, for example, at grid points in the grid as shown in FIG. 14 along a straight line in the sub-scanning direction.

Embodiment 1

Now, an ink jet printing method according to an embodiment of the present invention, which is executed by the above-mentioned ink jet printing apparatus 1, will be described below.

The ink jet printing apparatus 1 according to the present embodiment receives image data from, for example, a host apparatus (not shown) such as a host computer or a word processor and ejects ink to perform printing on a sheet according to the image data so that the image data can be reproduced with a set of dots formed with such ejected ink. When printing such image data, the ink jet printing apparatus 1 according to the present embodiment switches from one to another of two modes for print gradation through the manual operation of a switch (not shown) provided on the apparatus body or through commands provided by the host apparatus prior to transmitting the image data.

Figure 15:
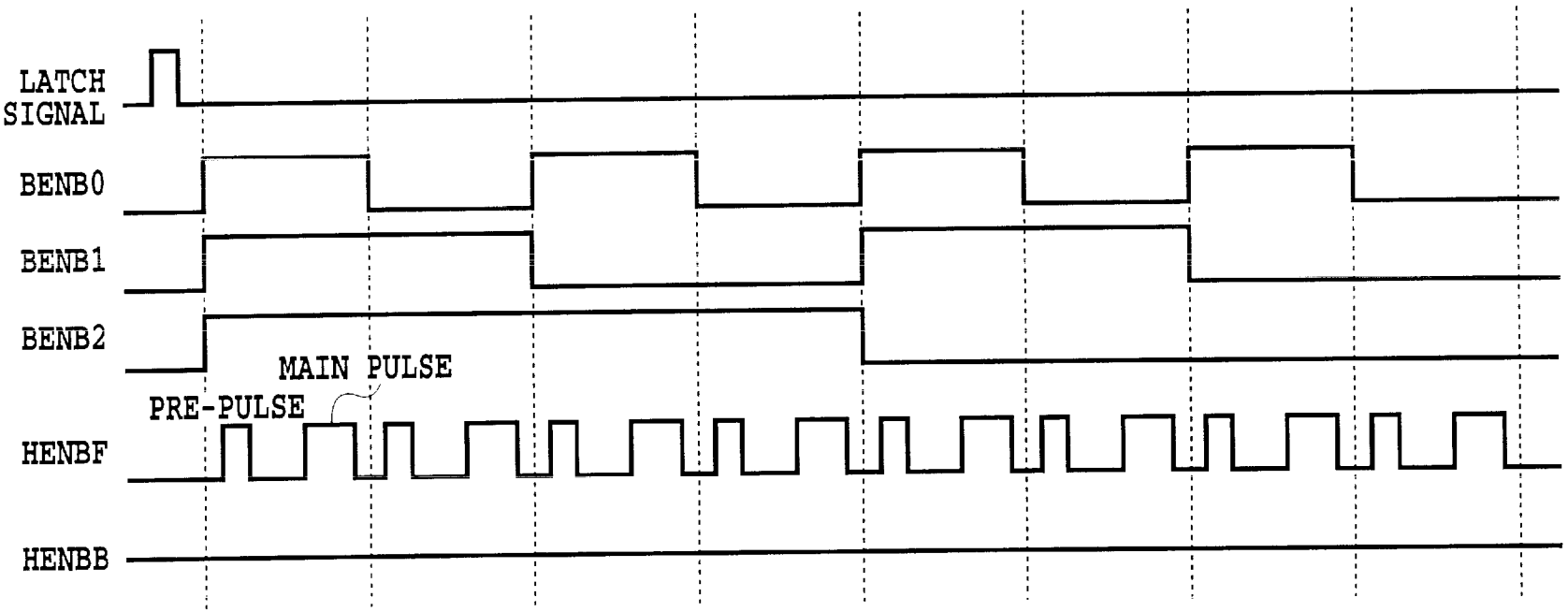
FIG. 15 is a waveform chart showing head drive signals used for driving only a front heater in the embodiment.

For example, when a mode of high-resolution is established as a first mode, pulse setting values are set to the front heater pulse generator 2201 and the rear heater pulse generator 2202 in the head driving pulse generator 2103 so that the signal HENBF is applied only to the driver circuit 54*f* provided for the front heater pulse generator 2201 as shown in FIG. 15. Then, ink ejection will be performed by means of the front heater 29*f* only. Thus, the amount of ejected ink will be decreased sufficiently to form small dots necessary for the high-resolution printing.

Figure 16:
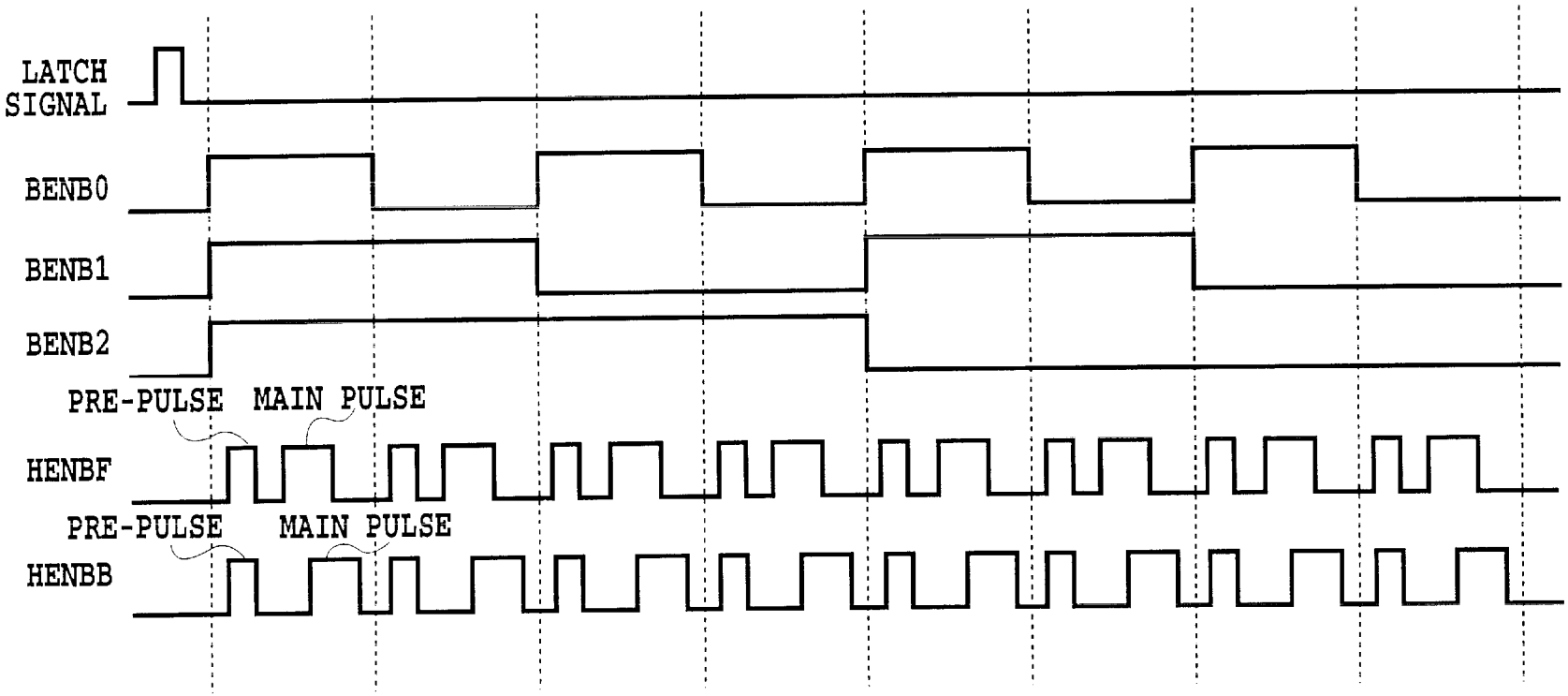
FIG. 16 is a waveform chart showing head drive signals used for driving both a front heater and a rear heater in the embodiment.
Figure 17:
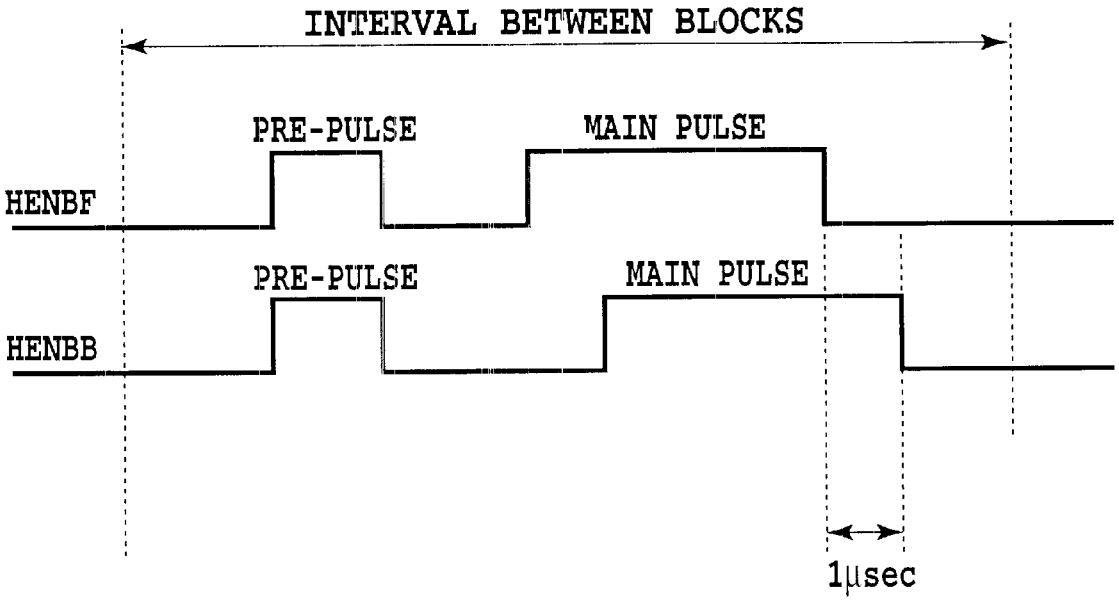
FIG. 17 is a waveform chart showing heat enable signals HENBF and HENBB used for driving the front heater and the rear heater, respectively, according to the first embodiment of the present invention.

On the other hand, when a mode of low-resolution is established as a second mode, the heat enable signals HENBF and HENBB are generated from the front heater pulse generator 2201 and the rear heater pulse generator 2202 in the head driving pulse generator 2103, respectively, as shown in FIG. 16, and therefore, both the front heater 29*f* and the rear heater 29*b* will be driven for each nozzle from which the ink should be ejected. Thus, the amount of ejected ink will be increased sufficiently to form large dots. According to the present embodiment, the pulse generation circuits 2201 and 2203 respectively set the signals so that the main pulse in the heat enable signal HENBB for the rear heater terminate with a time lag of approximately 1 μsec after the heat enable signal HENBF for the front heater, as shown in FIG. 17. Thus, a difference in ejection speed between the main drop section and the tailing section is reduced so that a dot formed of the main drop section and the tailing section can become more approximate circular shape.

Figure 18:
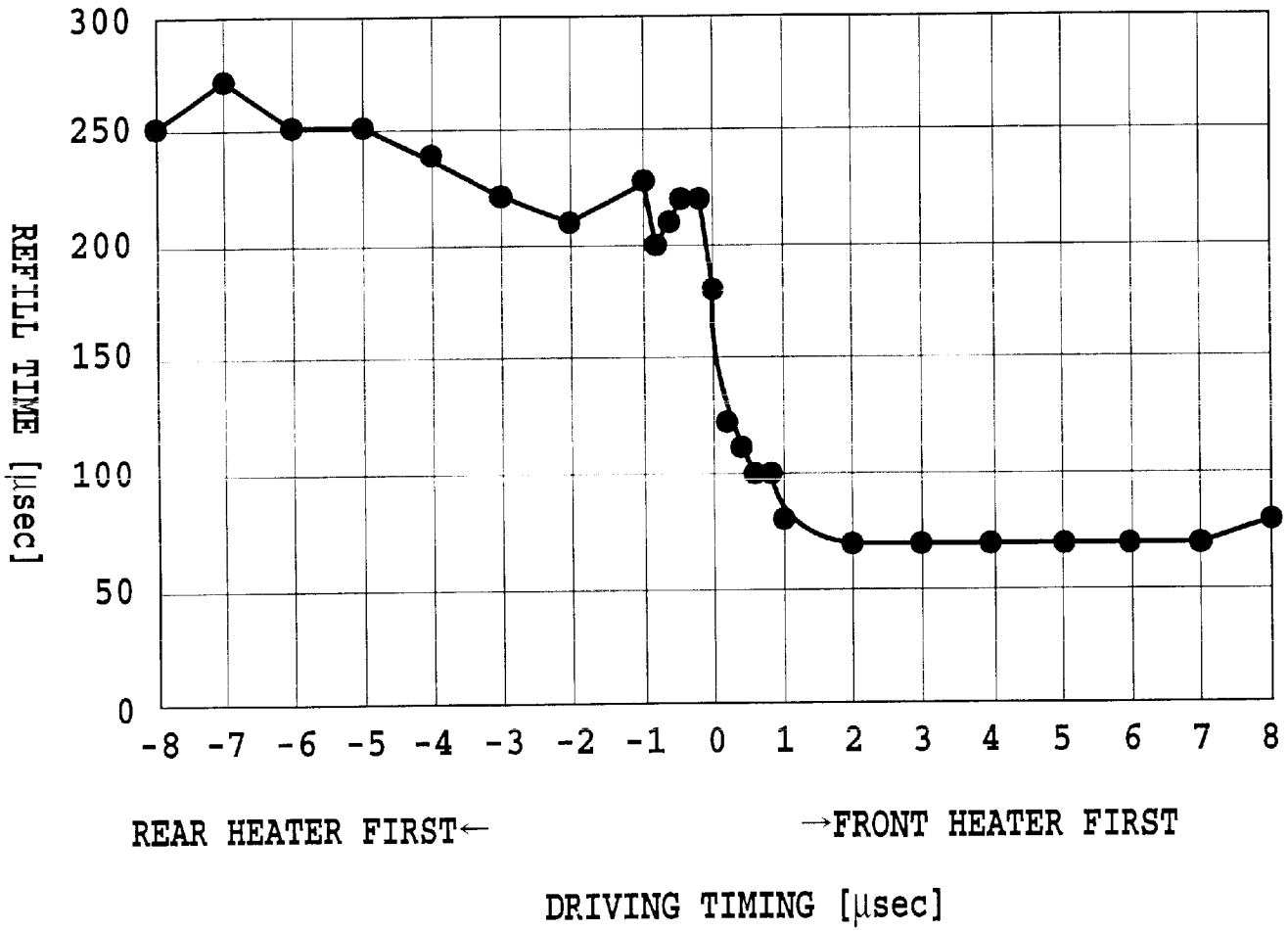
FIG. 18 is a diagram showing that refill time varies with the time lag in driving the front heater and the rear heater in the head according to the embodiment.

FIG. 18 is a diagram showing the relationship between refill time for an ink passage and the time lag between driving of the respective front and rear heaters in the print head used for the above-mentioned embodiment, that is, the relation between the refill time and the time lag between applications of the respective main pulses, in the case of controlling timings of the main pulses of the double pulses as a driving timing, as described above with reference to FIG. 17. As apparent from the figure, when the front heater is driven first (the driving timing value is positive), the refill time becomes shorter and thus good printing can be accomplished due to stable ink ejection because meniscus formation in the vicinity of the ejection opening can follow a high frequency used for driving the nozzle.

Embodiment 2

In the embodiment 1 described above, it is assumed that the front heater is driven prior to driving the rear heater. However, it should be noted that when sufficient refill time may be set depending upon a printing mode or the like, dots similar to those in the embodiment 1 can be formed even when the rear heater is driven first.

For example, in the case of a draft-printing mode in which the scanning speed of the print head is high and printing is performed by thinning a dot, the refill time in the nozzle may not be much of a problem. In such a case, the rear heater may be driven prior to the front heater as with the present embodiment. More specifically, a main pulse for the rear heater may be applied 4 μsec earlier than a main pulse for the front heater.

Other Embodiments

According to the two embodiments described above, a time lag in driving the front and rear heaters for printing can allow good printing dots to be formed.

Incidentally, in order to avoid or recover nozzle clogging due to dried or viscous ink, ink ejection for a recovery operation independent of a printing operation is usually performed in the ink jet printing apparatus. To this end, it is desirable that a large impulse should be given to nozzles during the ink ejection in order to remove an adhered or viscous substance in the vicinity of the nozzles. Therefore, the driving method of the front and the rear heaters should be suitably taken for the ink ejection in the recovery operation so that the product of ejected quantity of the ink and ejected speed of the ink may be greater. More specifically, it is most suitable for the present embodiment that both of the heaters are driven almost simultaneously. Thus, the present embodiment is configured by storing separately in the ROM different heater driving pulse settings used for the printing operation and the recovering operation and to switch these settings to be referenced for printing and recovering.

Figure 19:
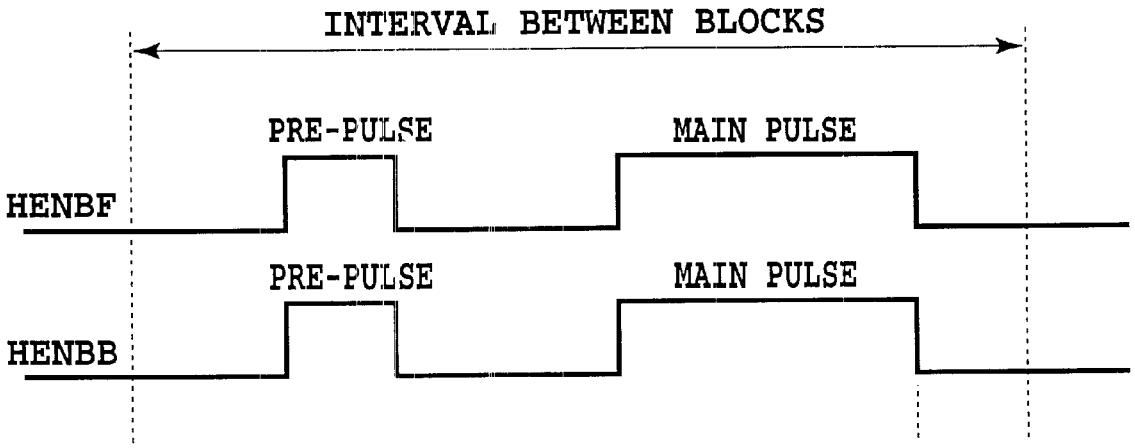
FIG. 19 is a waveform chart showing heat enable signals HENBF and HENBB according to another embodiment of the present invention.

Also in the present embodiment as with the previous embodiment, driving pulses for the printing operation are set as shown in FIG. 17 and driving pulses for the recovering are set as shown in FIG. 19 in which the two main pulses terminate almost simultaneously.

As shown in FIG. 18, when both heaters are driven simultaneously, the refill time becomes longer than the case where the front heater is driven first for the printing operation. Therefore, it is preferable that the head driving frequency for the recovering operation should be lower than the head driving frequency for the printing operation. More specifically, good recoverability can be achieved by driving the head at a frequency of 4000 Hz for the recovering operation while the head is driven at a frequency of 7200 Hz for the printing operation.

Moreover, the above-mentioned embodiments have been described as using the double pulses for driving the print head, but it should be noted that the present invention is not limited to these applications and that a single pulse may also be used. In this case, a time lag in driving the single pulse to be applied to the front and the rear heaters must satisfy the conditions described above.

The present invention achieves distinct effect when applied to a printing head or a printing apparatus which has means for generating thermal energy such as electro-thermal transducers or laser light, and which causes changes in ink by the thermal energy so as to eject ink. This is because such a system can achieve a high density and high resolution printing.

A typical structure and operational principle thereof are disclosed in U.S. Pat. Nos. 4,723,129 and 4,740,796, and it is preferable to use this basic principle to implement such a system. Although this system can be applied either to on-demand type or continuous type ink jet printing systems, it is particularly suitable for the on-demand type apparatus. This is because the on-demand type apparatus has electro-thermal transducers, each disposed on a sheet or liquid passage that retains liquid (ink), and operates as follows:

first, one or more drive signals are applied to the electro-thermal transducers to cause thermal energy corresponding to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a printing head, which is incorporated to the present invention: this structure includes heating portions disposed on bent portions in addition to a combination of the ejection orifices, liquid passages and the electro-thermal transducers disclosed in the above patents. Moreover, the present invention can be applied to structures disclosed in Japanese Patent Application Laid-open Nos. 59-123670 (1984) and 59-138461 (1984) in order to achieve similar effects. The former discloses a structure in which a slit common to all the electro-thermal transducers is used as ejection orifices of the electro-thermal transducers, and the latter discloses a structure in which openings for absorbing pressure waves caused by thermal energy are formed corresponding to the ejection orifices. Thus, irrespective of the type of the printing head, the present invention can achieve printing positively and effectively.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a printing head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing electro-thermal transducers or a combination of other heater elements and the electro-thermal transducers, and a means for carrying out preliminary ejection of ink independently of the ejection for printing. These systems are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multi-color and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electro-thermal transducers as described in Japanese Patent Application Laid-open Nos. 54-56847 (1979) or 60-71260 (1985). The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus for using a print head which has a plurality of electro-thermal transforming elements provided for one nozzle and generates a bubble by utilizing thermal energy caused by driving the plurality of electro-thermal transforming elements to eject an ink droplet and for performing printing onto a printing medium by ejecting the ink from the print head, said apparatus comprising:

scanning means for scanning the print head relative to the printing medium at a predetermined scanning speed; and driving means for driving the plurality of electro-thermal transforming elements of the print head to eject ink from the nozzle while said scanning means scans the print head at the predetermined scanning speed, said driving means driving the plurality of electro-thermal transforming elements at different timings during scanning at the predetermined scanning speed to eject the ink droplet having a main drop section and a tailing section so as to form a dot more approximate a circular shape than that formed with the ink ejected by driving the plurality of electro-thermal transforming elements simultaneously during scanning at the predetermined scanning speed.

2. An ink jet printing apparatus as claimed in claim 1, wherein said driving means drives the plurality of electrothermal transforming elements at the different timings so that a difference in ejection speeds between the main drop section and the tailing section of each ink droplet is minimized.

3. An ink jet printing apparatus as claimed in claim 1, wherein said driving means drives the plurality of electro-thermal transforming elements at different timings to differentiate generation timings of respective bubbles with respect to said driven electro-thermal transforming elements.

4. An ink jet printing apparatus as claimed in claim 3, wherein said driving means drives each of the plurality of electro-thermal transforming elements by supplying a double pulse driving signal having a pre-pulse and a main pulse between which a pause period exists to the plurality of electro-thermal transforming elements.

5. An ink jet printing apparatus as claimed in claim 4, wherein said driving means varies a waveform of the driving signal to differentiate the generation timings of bubbles.

6. An ink jet printing apparatus as claimed in claim 5, wherein said driving means varies the waveform of the driving signal by differentiating application timings of main pulses in the driving signals.

7. An ink jet printing apparatus as claimed in claim 1, wherein the print head has two electro-thermal transforming elements provided for one nozzle and said two electro-thermal transforming elements are arranged at different distances from a tip of said nozzle.

8. An ink jet printing apparatus as claimed in claim 7, wherein among said two electro-thermal transforming elements, the electro-thermal transforming element farther from said nozzle tip has a larger area than that closer to said nozzle tip.

9. An ink jet printing apparatus as claimed in claim 8, wherein said driving means drives said two electro-thermal transforming elements so that the electro-thermal transforming element closer to said nozzle tip may generate bubbles earlier than that farther from said nozzle tip.

10. An ink jet printing apparatus as claimed in claim 1, wherein said driving means drives the plurality of electro-thermal transforming elements simultaneously when a recovering operation for said print head is performed.

11. An ink jet printing apparatus as claimed in claim 10, wherein said driving means drives, for the recovering operation, the plurality of electro-thermal transforming elements at a lower frequency than that for a printing operation.

12. An ink jet printing method for using a print head which has a plurality of electro-thermal transforming elements provided for one nozzle and generates a bubble by utilizing thermal energy caused by driving the plurality of electro-thermal transforming elements to eject an ink droplet and for performing printing onto a printing medium by ejecting the ink from the print head, said method comprising the steps of:

scanning the print head relative to the printing medium at a predetermined scanning speed; and driving the plurality of electro-thermal transforming elements of the print head to eject ink from the nozzle while said scanning step scans the print head at the predetermined scanning speed, the plurality of electro-thermal transforming elements being driven at different timings during scanning at the predetermined scanning speed to eject the ink droplet having a main drop section and a tailing section so as to form a dot more approximate a circular shape than that formed with the ink ejected by driving the plurality of electro-thermal transforming elements simultaneously during scanning at the predetermined scanning speed.

13. An ink jet printing method as claimed in claim 12, wherein the plurality of electro-thermal transforming elements are driven at the different timings in said driving step so that a difference in ejection speeds between the main drop section and the tailing section of each ink droplet is minimized.

14. An ink jet printing method as claimed in claim 12, wherein said driving step drives the plurality of electro-thermal transforming elements at different timings to differentiate generation timings of respective bubbles with respect to said driven electro-thermal transforming elements.

15. An ink jet printing method as claimed in claim 14, wherein said driving step drives each of the plurality of electro-thermal transforming elements by supplying a double pulse driving signal having a pre-pulse and a main pulse between which a pause period exists to the plurality of electro-thermal transforming elements.

16. An ink jet printing method as claimed in claim 15, wherein said driving step varies a waveform of the driving signal to differentiate the generation timings of bubbles.

17. An ink jet printing method as claimed in claim 16, wherein said driving step varies the waveform of the driving signal by differentiating application timings of main pulses in the driving signals.

18. An ink jet printing method as claimed in claim 12, wherein the print head has two electro-thermal transforming elements provided for one nozzle and said two electro-thermal transforming elements are arranged at different distances from a tip of said nozzle.

19. An ink jet printing method as claimed in claim 18, wherein among said two electro-thermal transforming elements, the electro-thermal transforming element farther from said nozzle tip has a larger area than that closer to said nozzle tip.

20. An ink jet printing method as claimed in claim 19, wherein said driving step drives said two electro-thermal transforming elements so that the electro-thermal transforming element closer to said nozzle tip may generate bubbles earlier than that farther from said nozzle tip.

21. An ink jet printing method as claimed in claim 12, wherein said driving step drives the plurality of electro-thermal transforming elements simultaneously when a recovering operation for said print head is performed.

22. An ink jet printing method as claimed in claim 21, wherein said driving step drives, for the recovering operation, the plurality of electro-thermal transforming elements at a lower frequency than that for a printing operation.

* * * * *